US010705553B2

(12) United States Patent
Sakaguchi

(10) Patent No.: US 10,705,553 B2
(45) Date of Patent: Jul. 7, 2020

(54) CONSTANT CURRENT CIRCUIT FOR SUPPRESSING TRANSIENT VARIATION IN CONSTANT CURRENT

(71) Applicant: ABLIC Inc., Chiba-shi, Chiba (JP)

(72) Inventor: Kaoru Sakaguchi, Chiba (JP)

(73) Assignee: Ablic Inc., Chiba (JP)

( * ) Notice: Subject to any disclaimer, the term of this patent is extended or adjusted under 35 U.S.C. 154(b) by 0 days.

(21) Appl. No.: 16/555,439

(22) Filed: Aug. 29, 2019

(65) Prior Publication Data

US 2020/0081474 A1 Mar. 12, 2020

(30) Foreign Application Priority Data

Sep. 7, 2018 (JP) ..... 2018-168264

(51) Int. Cl.
*G05F 3/26* (2006.01)

(52) U.S. Cl.
CPC ..... *G05F 3/262* (2013.01)

(58) Field of Classification Search
CPC ..... G05F 3/262
See application file for complete search history.

(56) References Cited

U.S. PATENT DOCUMENTS

2006/0125460 A1* 6/2006 Mheen ..... G05F 3/262 323/313
2009/0066313 A1* 3/2009 Kimura ..... G05F 3/262 323/313
2009/0201006 A1 8/2009 Mitani et al.
2012/0306549 A1* 12/2012 Nagatomo ..... G05F 3/242 327/143

FOREIGN PATENT DOCUMENTS

JP 2009-193211 A 8/2009

* cited by examiner

*Primary Examiner* — Fred E Finch, III
*Assistant Examiner* — Rafael O. De León Domenech
(74) *Attorney, Agent, or Firm* — Brinks Gilson & Lione

(57) ABSTRACT

A constant current circuit includes a first current mirror circuit connected to a first power supply and having a first input transistor and a first output transistor of a first conductivity type, a second current mirror circuit having a second output transistor of a second conductivity type provided between the first input transistor and a second power supply, and a second input transistor of the second conductivity type provided between the first output transistor and the second power supply, a resistor interposed between the second output transistor and the second power supply, and a capacitor having one end connected to the first power supply and the other end connected to a connecting point of the second output transistor and the resistor.

3 Claims, 4 Drawing Sheets

CONSTANT CURRENT CIRCUIT FOR SUPPRESSING TRANSIENT VARIATION IN CONSTANT CURRENT

RELATED APPLICATIONS

This application claims priority to Japanese Patent Application No. 2018-168264, filed on Sep. 7, 2018, the entire content of which is incorporated herein by reference.

BACKGROUND OF THE INVENTION

1. Field of the Invention

The present invention relates to a constant current circuit which generates a constant current.

2. Description of the Related Art

In general, a constant current circuit is widely used in a semiconductor integrated circuit. Characteristics of the constant current circuit are important factors in determining the performance of the semiconductor integrated circuit.

FIG. 4 illustrates a configuration of a conventional constant current circuit 100 in prior art. The constant current circuit 100 includes a current mirror circuit 101 constituted of transistors M1 and M2 each being a P-channel MOS transistor, a current mirror circuit 102 constituted of transistors M3 and M4 each being an N-channel MOS transistor, and a resistor R1 (refer to, for example, Japanese Patent Application Laid-Open No. 2009-193211). The resistor R1 is interposed between a source of the transistor M3 and a conductive line LVSS for a power supply voltage VSS.

Further, a startup circuit 103 supplies a prescribed current from an internally provided current source to the transistor M1 to supply a mirror current to the current mirror circuit 101, thereby starting up the constant current circuit.

As described above, the constant current circuit is constituted as a current mirror circuit which supplies a reference current corresponding to the mirror current flowing through the transistor M1.

There has been a demand that the current mirror circuit compensates variations in the transistor and the like due to a manufacturing process and continually supplies a constant reference current.

In the constant current circuit according to Japanese Patent Application Laid-Open No. 2009-193211, however, at an occurrence of fluctuation of the power supply voltage VDD applied to the conductive line LVDD, the constant current fluctuates in a transient state corresponding to the fluctuation in the power supply voltage VDD since transient current flows through parasitic capacitances between each terminal of the transistor and the conductive lines.

That is, in the constant current circuit, since the transient mirror current increases upon rising of the power supply voltage VDD from a prescribed voltage, the constant current is held at an increased state during a period corresponding to this increase. On the other hand, since the transient mirror current decreases upon lowering of the power supply voltage VDD from the prescribed voltage, the constant current is held at a decreased state during a period corresponding to this decrease.

SUMMARY OF THE INVENTION

The present invention has been made in view of such circumstances, and it is an object of the present invention to provide a constant current circuit capable of, at the time of a fluctuation in a power supply voltage VDD, suppressing a transient variation in a constant current corresponding to the fluctuation in the power supply voltage.

According to one aspect of the present invention, there is provided a constant current circuit which includes a first current mirror circuit connected to a first power supply and having a first input transistor and a first output transistor of a first conductivity type, a second current mirror circuit having a second output transistor of a second conductivity type provided between the first input transistor and a second power supply, and a second input transistor of the second conductivity type provided between the first output transistor and the second power supply, a resistor interposed between the second output transistor and the second power supply, and a capacitor having one end connected to the first power supply and the other end connected to a connecting point of the second output transistor and the resistor.

According to the present invention, there can be provided a constant current circuit capable of, at the time of a fluctuation in a power supply voltage VDD, suppressing a transient variation in a constant current corresponding to the fluctuation in the power supply voltage.

DETAILED DESCRIPTION OF THE PREFERRED EMBODIMENTS

Preferred embodiments of the present invention will hereinafter be described with reference to the accompanying drawings.

First Embodiment

Figure 1:
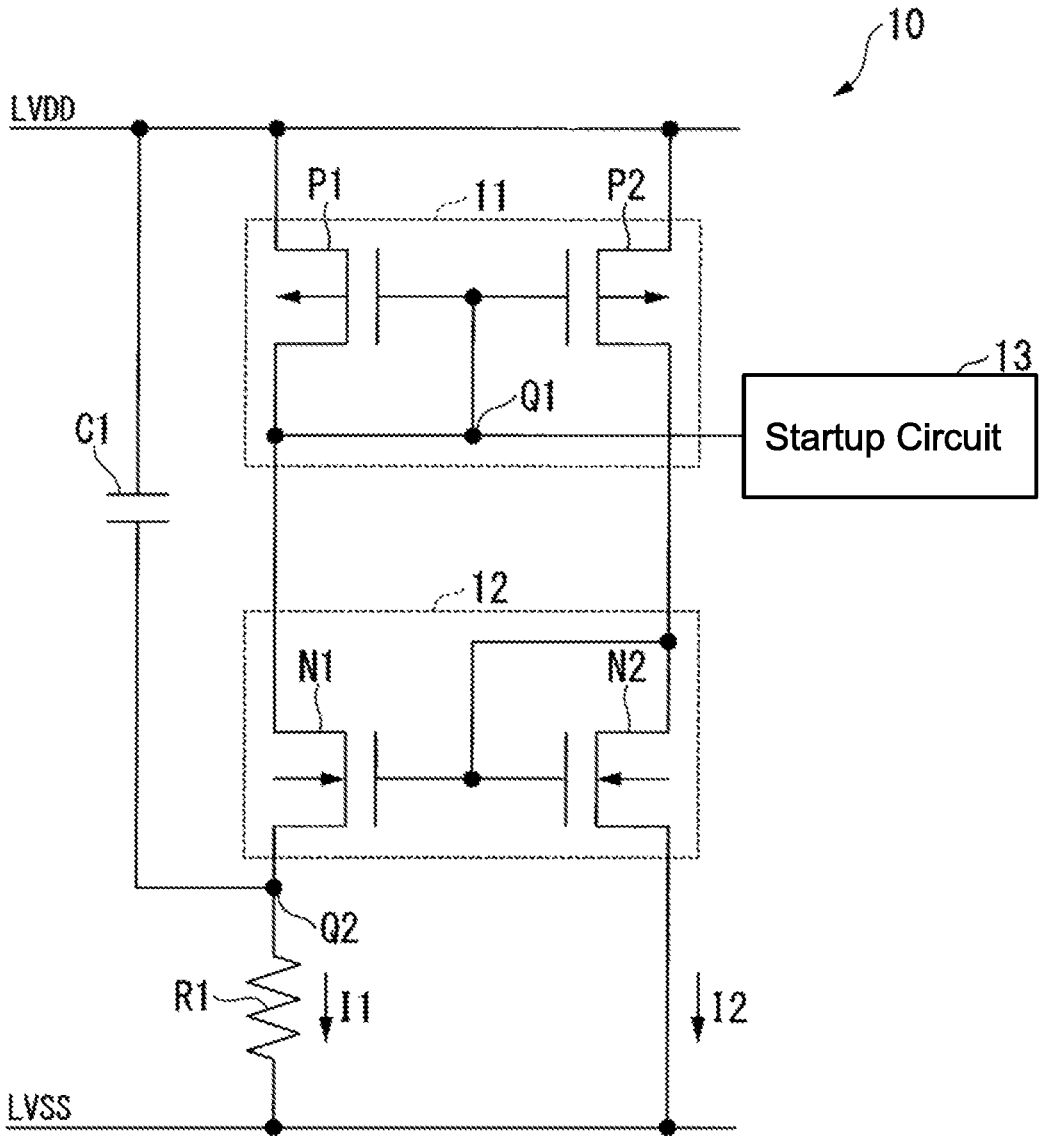
FIG. 1 is a circuit diagram illustrating a configuration example of a constant current circuit according to a first embodiment.

FIG. 1 is a circuit diagram illustrating a configuration example of a constant current circuit according to the first embodiment. The constant current circuit 10 includes a first current mirror circuit 11, a second current mirror circuit 12, a startup circuit 13, a resistor R1, and a capacitor C1.

The first current mirror circuit 11 includes transistors P1 (first input transistor) and P2 (first output transistor) each being a P-channel MOS transistor or a transistor of the first conductivity type. Further, the second current mirror circuit 12 includes transistors N1 (second output transistor) and N2 (second input transistor) each being an N-channel MOS transistor or a transistor of the second conductivity type.

The transistor P1 has a source connected to a conductive line LVDD for a power supply voltage VDD (first power supply) and a gate and a drain connected to an output terminal of the startup circuit 13. Here, a connecting point of the gate of the transistor P1 and the output terminal of the startup circuit 13 is Q1.

The transistor P2 has a source connected to the conductive line LVDD for the power supply voltage VDD and a gate connected to the gate of the transistor P1.

The transistor N1 has a drain connected to the drain of the transistor P1 and a gate connected to a gate of the transistor N2.

The transistor N2 has a drain and a gate connected to a drain of the transistor P2 and a source connected to a conductive line LVSS for a power supply voltage VSS (second power supply).

The resistor R1 has one end connected to a source of the transistor N1 and the other end connected to the conductive line LVSS for the power supply voltage VSS. Here, a connecting point of the source of the transistor N1 and one end of the resistor R1 is Q2. Further, as the resistor R1, for example, a MOS resistor (on-resistance of a MOS transistor) may be used in addition to a resistor formed by polysilicon, diffusion or the like.

The capacitor C1 has one end connected to the conductive line LVDD for the power supply voltage VDD and the other end connected to the source of the transistor N1.

In the configuration of the constant current circuit 10, there exists a threshold differential voltage ΔVT (=VTN1−VTN2) between a threshold voltage VTN1 of the transistor N1 and a threshold voltage VTN2 of the transistor N2.

The threshold differential voltage ΔVT is therefore generated at the connecting point Q2 due to a voltage drop across the resistor R1 in the operation at a second operation point.

The constant current circuit 10 provides a current flowing through the resistor R1 corresponding to the threshold differential voltage ΔVT as a constant current. For example, the constant current is taken out for use by another unillustrated current mirror circuit.

A description will next be made as to the operation of the constant current circuit 10 in FIG. 1.

There exist in the constant current circuit 10, the first operation point at which no current flows, and the second operation point at which the constant current, on the contrary, flows through the constant current circuit 10.

Upon causing the constant current circuit 10 to start the generation of the constant current, the startup circuit 13 forces a flow of a prescribed mirror current through the transistor P1 to shift the first operation point to the second operation point and thereby start up the constant current circuit 10.

The voltage VQ2 at the connecting point Q2, i.e., at the source of the transistor N1 lowers through the capacitor C1 at an occurrence of a reducing fluctuation with a step down of the power supply voltage VDD at the conductive line LVDD during the operation at the operation point 2. At this time, the transient current flows through the capacitor C1 from the conductive line LVSS side to the conductive line LVDD side, and hence the voltage VQ2 of the connecting point Q2 reduces.

Then, since the voltage VQ2 of the source of the transistor N1 reduces corresponding to the reduction in the power supply voltage VDD, the influence of a current through a parasitic capacitance due to the reduction in the power supply voltage VDD can be cancelled, suppressing a transient decrease in the current flowing through the transistor N1 due to the reduction in the power supply voltage VDD.

Further, since the current flowing through the transistor N1 is maintained, the current flowing through each of the transistors P1, P2, and N2 is also maintained, thereby making it possible to suppress the transient decrease in the constant current due to the reduction of the power supply voltage VDD.

On the other hand, the voltage VQ2 at the connecting point Q2, i.e., at the source of the transistor N1 rises through the capacitor C1 at an occurrence of an increasing fluctuation with a step up of the power supply voltage VDD at the conductive line LVDD during the operation at the operation point 2. At this time, the transient current flows through the capacitor C1 from the conductive line LVDD side to the conductive line LVSS side, and hence the voltage VQ2 of the connecting point Q2 rises.

Then, since the voltage VQ2 of the source of the transistor N1 rises corresponding to the rise in the power supply voltage VDD, the influence of a current through the parasitic capacitance due to the rise in the power supply voltage VDD can be cancelled, suppressing a transient increase in the current flowing through the transistor N1 due to the rise in the power supply voltage VDD.

Further, since the current flowing through the transistor N1 is maintained, the current flowing through each of the transistors P1, P2, and N2 is also maintained, thereby making it possible to suppress the transient increase in the constant current due to the rise of the power supply voltage VDD.

According to the present embodiment as described above, by providing the capacitor C1 between the conductive line LVDD and the source of the transistor N1 (connecting point Q2), the fluctuation in the power supply voltage VDD is transmitted to the connecting point Q2 in real time, i.e., the voltage VQ2 of the source of the transistor N1 can be controlled in accordance with the fluctuation in the power supply voltage VDD.

According to the present embodiment, it is thereby possible to cancel the fluctuation in the power supply voltage VDD, maintain the current flowing through the transistor N1, and suppress the transient variation in the constant current due to the fluctuation in the power supply voltage VDD.

Further, the capacitor C1 allows the transient current to flow corresponding to the fluctuation in the power supply voltage VDD to control the voltage VQ2 of the source of the transistor N1.

Since there is a need to suitably supply the transient current in order to cancel the fluctuation in the power supply voltage VDD, the capacitance of the capacitor C1 is therefore required to be appropriately set corresponding to the constants of each of the transistors P1, P2, N1, and N2 and the resistor R1, and the current value of the constant current.

Figure 2A:
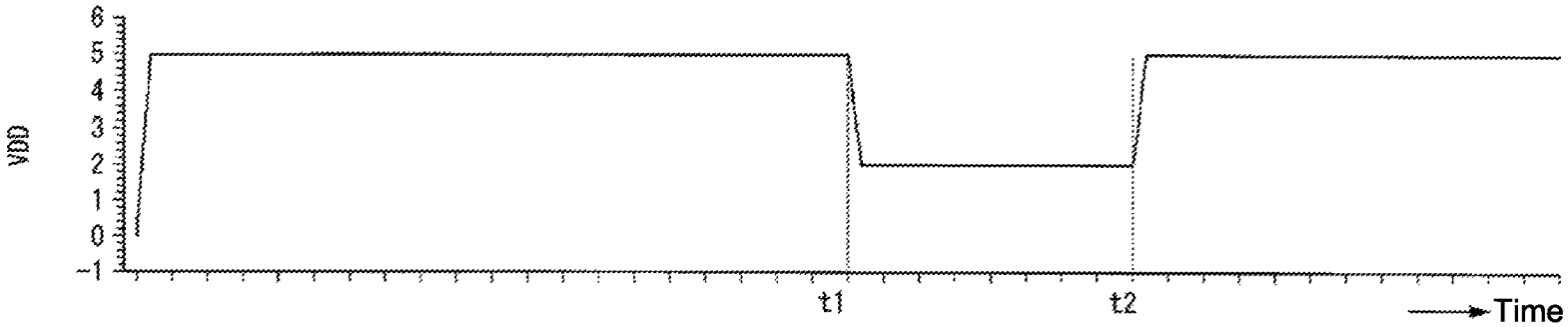
FIGS. 2A-2C are waveform diagrams of simulation results illustrating changes in a constant current due to a fluctuation in a power supply voltage VDD depending on the presence or absence of a capacitor C1 in the constant current circuit.
Figure 2B:
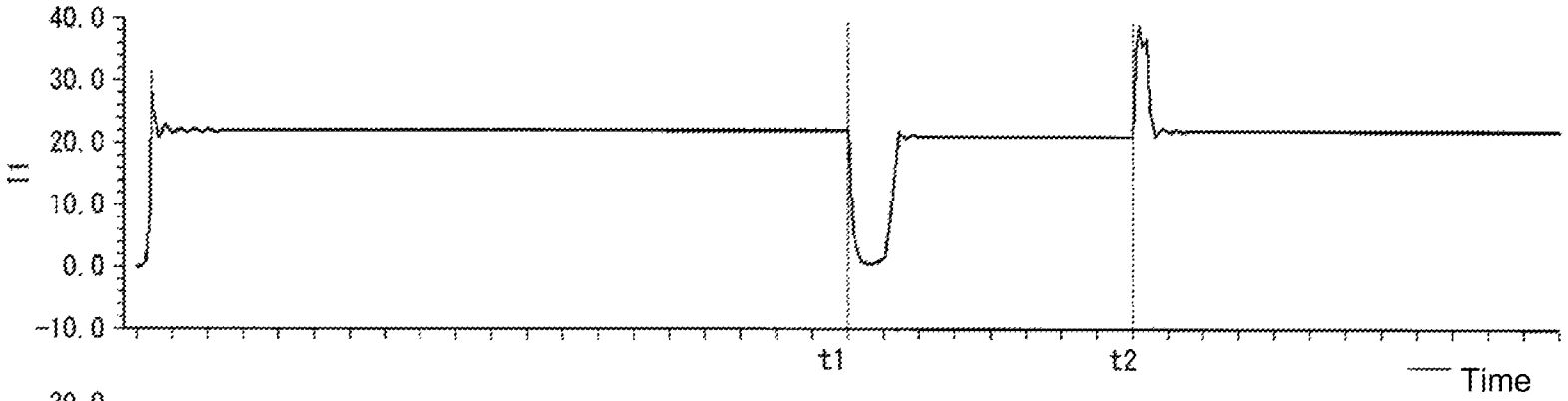
Figure 2C:
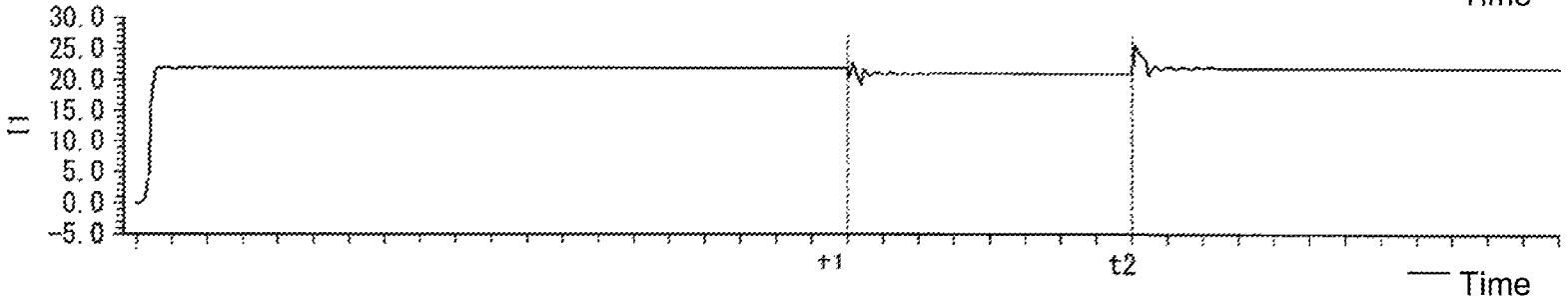

FIGS. 2A-2C are waveform diagrams of simulation results illustrating changes in the constant current due to the fluctuation in the power supply voltage VDD depending on the presence or absence of the capacitor C1 in the constant current circuit.

FIG. 2A is a waveform diagram illustrating the fluctuation in the power supply voltage VDD in which the vertical axis indicates the power supply voltage VDD, and the horizontal axis indicates time.

Figure 4:
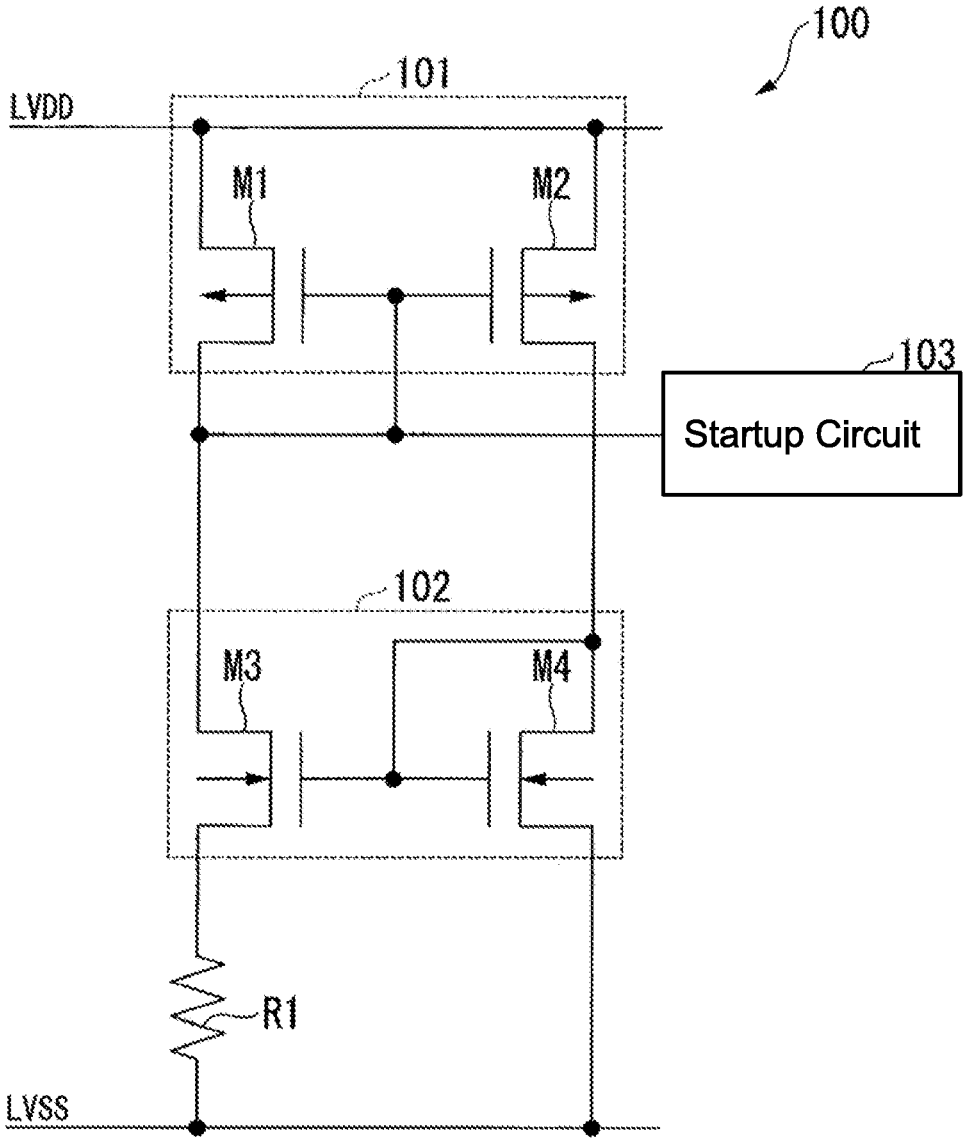
FIG. 4 PRIOR ART
FIG. 4 is a circuit diagram illustrating a conventional constant current circuit in prior art.

FIG. 2B is a waveform diagram illustrating a change in the constant current I1 in the constant current circuit 100 having no capacitor C1 which is illustrated in FIG. 4 in which the vertical axis indicates the value of the constant current, and the horizontal axis indicates time FIG. 2C is a waveform diagram illustrating a change in the constant current I1 in the constant current circuit 10 according to the present embodiment having the capacitor C1 which is illustrated in FIG. 1 in which the vertical axis indicates the value of the constant current, and the horizontal axis indicates time.

As illustrated in FIG. 2A, at time t1, the power supply voltage VDD drops from 5V to 2V (step-down).

In view of the above, in the conventional constant current circuit 100 as illustrated in FIG. 2B, the current flowing through the transistor M1 decreases corresponding to the drop of the power supply voltage VDD, so that the transient constant current reduces. Then, a prescribed time is required until each of the transistors M1, M2, M3, and M4 stably supplies a prescribed constant current in accordance with the power supply voltage VDD after its drop. During the prescribed time, the constant current of the constant current circuit 100 is greatly deviated from the prescribed current value. There is therefore a case in which other circuits using the constant current supplied from the constant current circuit 100 enter into an unstable operation due to the transient change in the constant current.

On the other hand, in the constant current circuit 10 according to the present embodiment as illustrated in FIG. 2C, the voltage VQ2 of the source of the transistor N1 drops by the capacitor C1 such that the current of the transistor N1 is maintained in spite of the drop of the power supply voltage VDD, so that the current flowing through the transistor P1 does not decrease, and a flow of the constant current is stable against the fluctuation in the power supply voltage VDD.

With this reason, there is no transient decrease in the constant current as in the constant current circuit 100 even though the power supply voltage VDD drops, and other circuits using the constant current supplied from the constant current circuit 10 do not enter an unstable operation.

Next, as illustrated in FIG. 2A, at time t2, the power supply voltage VDD rises from 2V to 5V (step-up).

Consequently, in the conventional constant current circuit 100 as illustrated in FIG. 2B, the current flowing through the transistor M1 increases corresponding to the rise of the power supply voltage VDD, so that the transient constant current increases. Then, a prescribed time is required until each of the transistors M1, M2, M3, and M4 stably supplies a prescribed constant current in accordance with the power supply voltage VDD after its rise. During the prescribed time, the constant current of the constant current circuit 100 is greatly deviated from the prescribed current value in a manner similar to the case where the power supply voltage VDD reduces. There is therefore a case in which other circuits using the constant current supplied from the constant current circuit 100 enter into an unstable operation due to the transient change in the constant current.

On the other hand, in the constant current circuit 10 according to the present embodiment as illustrated in FIG. 2C, the voltage VQ2 of the source of the transistor N1 rises by the capacitor C1 such that the current of the transistor N1 is maintained in spite of the rise of the power supply voltage VDD, so that the current flowing through the transistor P1 does not increase, and a flow of the constant current is stable against the fluctuation in the power supply voltage VDD.

With this view, as with the case where the power supply voltage VDD reduces, even though the power supply voltage VDD rises, there is no transient increase in the constant current as in the constant current circuit 100 and other circuits using the constant current supplied from the constant current circuit 10 do not enter an unstable operation.

Second Embodiment

Figure 3:
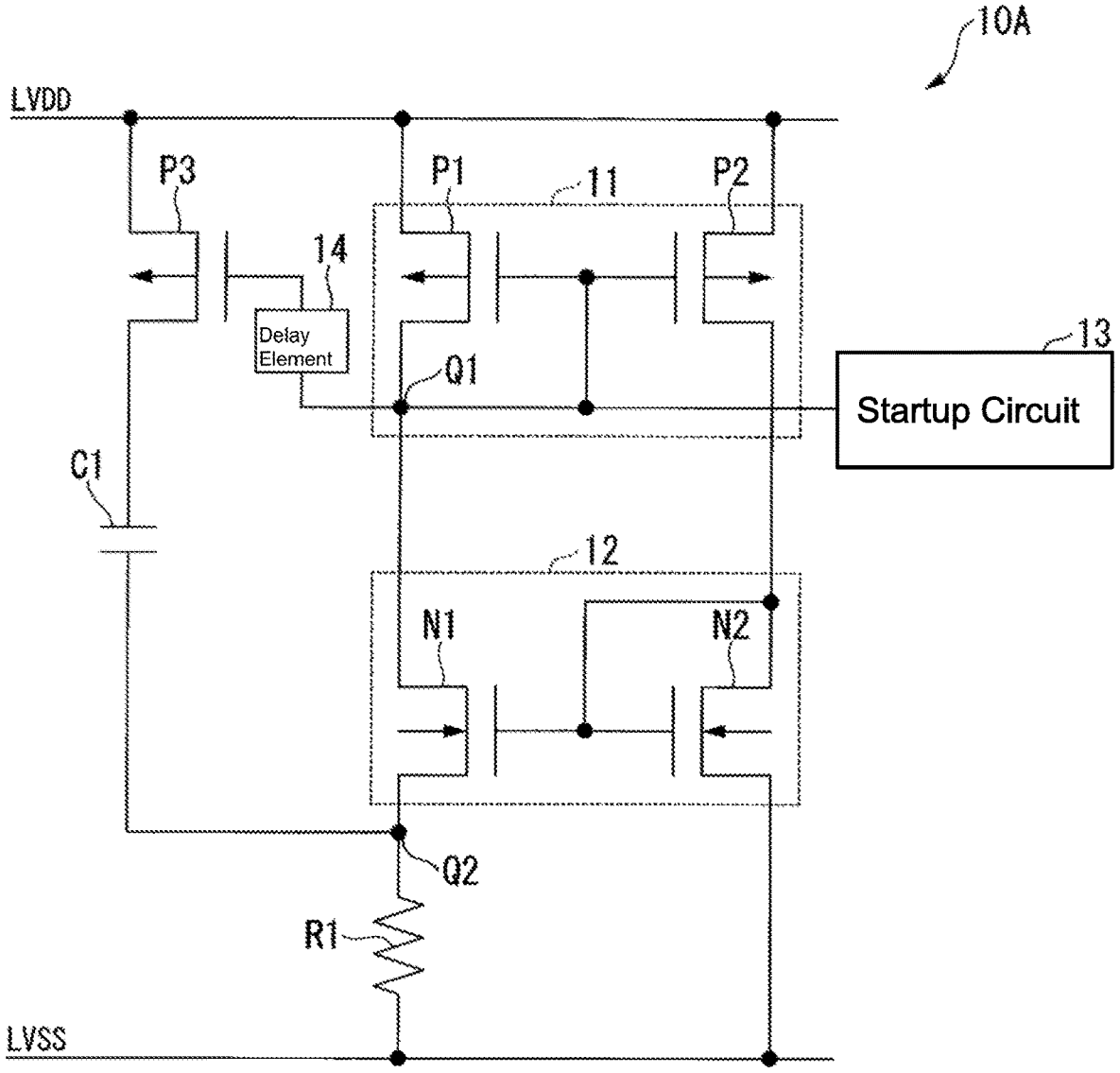
FIG. 3 is a circuit diagram illustrating a configuration example of a constant current circuit according to a second embodiment.

FIG. 3 is a circuit diagram illustrating a configuration example of a constant current circuit according to the second embodiment.

The constant current circuit 10A includes a first current mirror circuit 11, a second current mirror circuit 12, a startup circuit 13, a resistor R1, a capacitor C1, a transistor P3, and a delay element 14. In the circuit diagram of FIG. 3, components similar to those in FIG. 1 are denoted by the same reference numerals.

The transistor P3 is a P-channel MOS transistor, which is also a transistor of the first conductivity type, and has a source connected to the conductive line LVDD and a drain connected to one end of the capacitor C1.

The capacitor C1 has the other end connected to a connecting point Q2.

The delay element 14 has one end connected to a gate of the transistor P3 and the other end connected to a connecting point Q1. Here, the delay element 14 may be constituted using a MOS resistor in addition to a resistor formed by polysilicon, diffusion or the like, for example.

In the first embodiment with the provision of the capacitor C1, on the one hand, the effect described in the first embodiment is brought about, on the other hand, the time taken till the generation of a stable constant current at a second operation point may be delayed at the startup by the startup circuit 13.

That is, upon the startup circuit 13 supplying a mirror current to the transistor P1, all the current flowing through the transistor N1 does not flow through the resistor R1, and a part of the current flows through the capacitor C1.

A current exceeding a prescribed constant current hence flows through the transistor N1 to reduce the voltage of the connecting point Q1 and thereby suppress the startup of the constant current circuit 10, so that the time taken to make a stable operation at the second operation point is delayed.

As a consequence, in the first embodiment, the capacitor C1 is operative for the fluctuation in the power supply voltage VDD during the generation of the constant current at the second operation point, but it becomes disadvantageous during the startup at which the constant current circuit 10 shifts from the first operation point to the second operation point.

In the second embodiment the transistor P3 is therefore provided to make the capacitor C1 unconnected to the conductive line LVDD at the time of startup of the constant current circuit 10A. That is, the transistor P3 makes the capacitor C1 operative during an on state (connected to the conductive line LVDD) and makes the capacitor C1 inoperative during an off state (disconnected from the conductive line LVDD).

The transistor P3 then transitions from the off state to the on state with the reduction in the voltage VQ1 of the connecting point Q1 to make the capacitor C1 operative.

As described above, it is necessary to set an off state of the transistor P3 during the transient period until the constant current circuit 10A supplies the stable constant current and set an on state of the transistor P3 after the stable constant current flows.

The delay element 14 is thereby provided between the gate of the transistor P3 and the connecting point Q1 to delay a change in the voltage of the connecting point Q2 such that the off state is maintained while the constant current circuit transitions from the first operation point to the second operation point.

It is however unnecessary to provide the delay element 14 when a delay time sufficient for the propagation of the change in the voltage of the connecting point Q1 to the gate of the transistor P3 is obtained by each of the capacitance of the gate of the transistor P3, and the capacitance and resistance components of a conductive line between the connecting point Q1 and the gate of the transistor P3.

According to the present embodiment described above, by providing the capacitor C1, the influence on the constant current of the constant current circuit 10A due to the fluctuation in the power supply voltage VDD can be canceled, the current flowing through the transistor N1 can be maintained, and the transient variation in the constant current due to the fluctuation in the power supply voltage VDD can be suppressed. Further, the capacitor C1 can be separated from the constant current circuit 10A at the time of startup of the constant current circuit 10A, and hence the delay caused by the capacitor C1 of the time up to the supply of the stable constant current at the second operation point at the time of startup of the constant current circuit 10A can be suppressed.

Although the embodiments of the present invention have been described above in detail with reference to the drawings, the specific configurations are not limited to those in the present embodiments and include even design in the scope not departing from the spirit of the present invention, etc.

For example, in the startup circuit 13, the output terminal thereof may be connected to a gate and a drain of a transistor N2.

What is claimed is:

1. A constant current circuit, comprising:

a first current mirror circuit connected to a first power supply and having a first input transistor and a first output transistor of a first conductivity type;

a second current mirror circuit having a second output transistor of a second conductivity type provided between the first input transistor and a second power supply, and a second input transistor of the second conductivity type provided between the first output transistor and the second power supply;

a resistor interposed between the second output transistor and the second power supply; and a capacitor having one end connected to the first power supply and the other end connected to a connecting point of the second output transistor and the resistor, wherein the capacitor is configured to cancel voltage fluctuations.

2. The constant current circuit according to claim 1, further comprising a third transistor of the first conductivity type interposed between the first power supply and the one end of the capacitor and having a gate connected to a gate and a drain of the first input transistor.

3. The constant current circuit according to claim 2, further comprising a delay element configured to delay an on state of the third transistor.

* * * * *